US006106443A

United States Patent [19]

Kuo

[11] Patent Number: 6,106,443

[45] Date of Patent: Aug. 22, 2000

[54] PUNCHING BAG

[76] Inventor: James Y. C. Kuo, 13F, No. 500, Sec. 2, Li-Ming Rd., Nan-Tun Dist., Taichung City, Taiwan

[21] Appl. No.: 09/321,265

[22] Filed: May 27, 1999

[51] Int. Cl.[7] ..... A63B 69/34

[52] U.S. Cl. ..... 482/83; 482/87; 482/90

[58] Field of Search ..... 482/83–90; 273/55 A, 273/26 R

[56] References Cited

U.S. PATENT DOCUMENTS

| | | | |
|---|---|---|---|
| 1,264,559 | 6/1918 | Faver et al. | 482/90 |
| 2,037,508 | 4/1936 | Gilman | 482/90 |
| 2,197,545 | 4/1940 | Bachman et al. | 482/90 |
| 2,237,599 | 4/1941 | Gilman | 482/90 |
| 2,937,872 | 5/1960 | Gilman | 482/90 |
| 4,527,796 | 7/1985 | Critelli | 482/83 |
| 5,624,358 | 4/1997 | Hestilow | 482/90 |

*Primary Examiner*—Jerome Donnelly
*Attorney, Agent, or Firm*—Christensen O'Connor Johnson Kindness PLLC

[57] ABSTRACT

A punching bag includes a base, a punch body and an outside bag. The base includes a base envelope and a weighing member filled in the base envelope. The punch body is disposed above the base, and includes a punch envelope and a fluid filled in the punch envelope. The punch body is lighter than the base. The bag includes a lower enclosing portion filled by the base and having a first joint end with stitching holes, an upper enclosing portion filled by the punch body and having a second joint end with stitching holes, and a cord threading through the stitching holes and fastening together the first and second joint ends.

10 Claims, 6 Drawing Sheets

PUNCHING BAG

BACKGROUND OF THE INVENTION

1. Field of the Invention

The invention relates to a punching bag, more particularly to a punching bag which includes an outside bag enclosing two envelopes that are respectively filled with a weighing member and a fluid.

2. Description of the Related Art

A conventional punching bag, as shown in FIG. 1, includes a base unit which has a hollow casing 1 filled with water or sand via an inlet 101 disposed on a top face of the casing 1, a connecting unit 2, and a cylindrical bag 3 filled with gas. The connecting unit 2 includes an upper rod 201 inserted into the bag 3, a lower rod 203 inserted into a through hole 102 in the casing 1, and a spring coil 202 interconnecting vertically the upper and lower rods 201, 203. The base unit provides stability, while the bag 3 can be used for punching.

Another conventional punching bag, as shown in FIG. 2, includes a base 4 having an inner space filled with a liquid 401, a connecting part 5 connected to the base 4, and a punch body 6 connected to the connecting part 5. Both the connecting part 5 and the punch body 6 are inflatable.

In the above-mentioned conventional punching bags, as both the gas-filled bag 3 and the punch body 6 are inflated to a high pressure, the external surfaces thereof are usually tensed and stiff so that a realistic feeling experienced during boxing cannot be obtained. In addition, since the bag 3 and the punch body 6 are limited to gas-impervious materials, it is difficult to conduct surface treatment for improving resiliency or softness of the bag 3 and the punch body 6 although formation of decorative patterns is possible.

SUMMARY OF THE INVENTION

Therefore, the main object of the present invention is to provide a punching bag which can provide a realistic feeling experienced during boxing, which has a simple structure, and which can be assembled easily.

According to the present invention, a punching bag includes a base, a punch body and an outside bag. The base includes a base envelope and a weighing member filled in the base envelope. The punch body is disposed above the base, and includes a punch envelope and a fluid received in the punch envelope. The punch body is lighter than the base. The bag includes a lower enclosing portion filled by the base and having a first joint end with stitching holes, an upper enclosing portion filled by the punch body and having a second joint end with stitching holes, and a cord threading through the stitching holes and fastening together the first and second joint ends.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
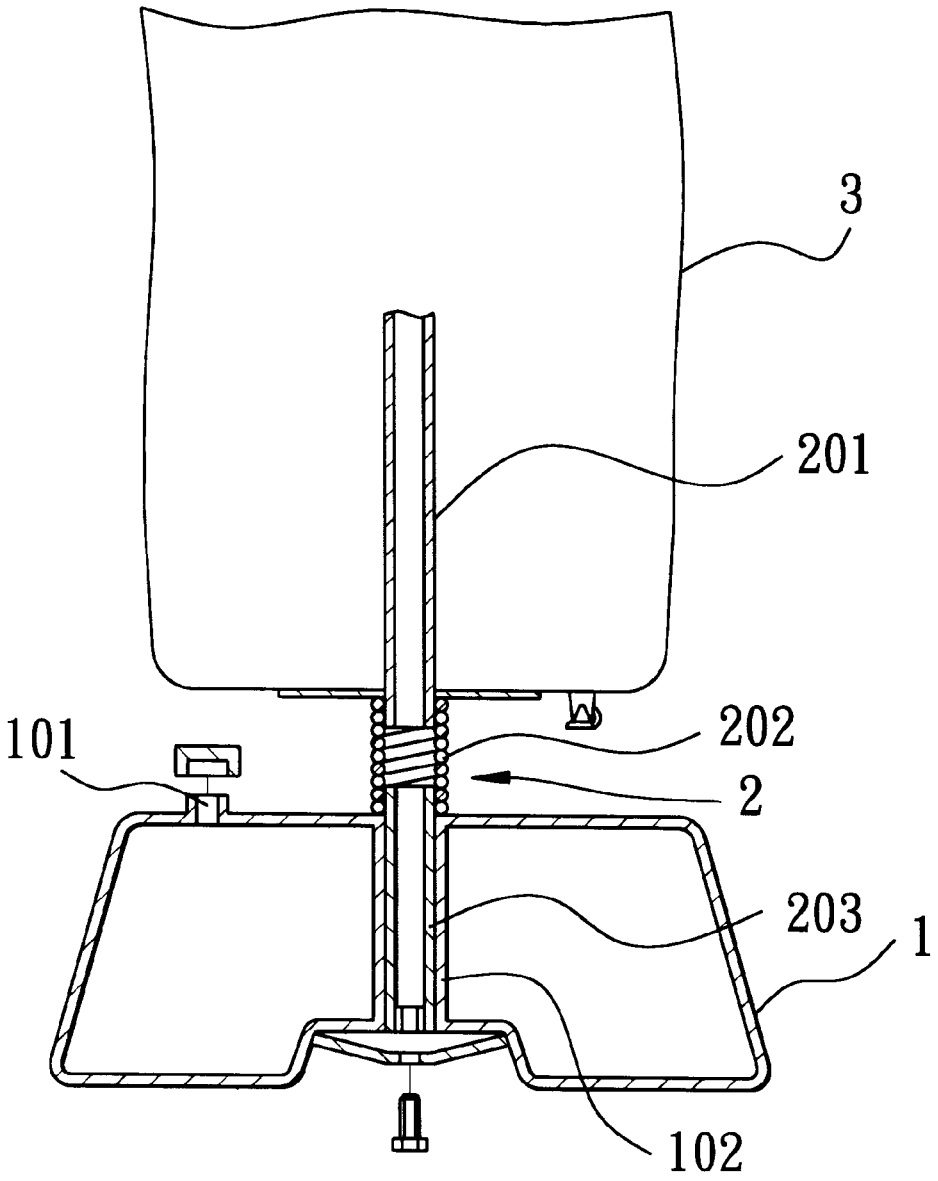
FIG. 1 PRIOR ART
FIG. 1 is a fragmentary sectional view of a conventional punching bag.
Figure 2:
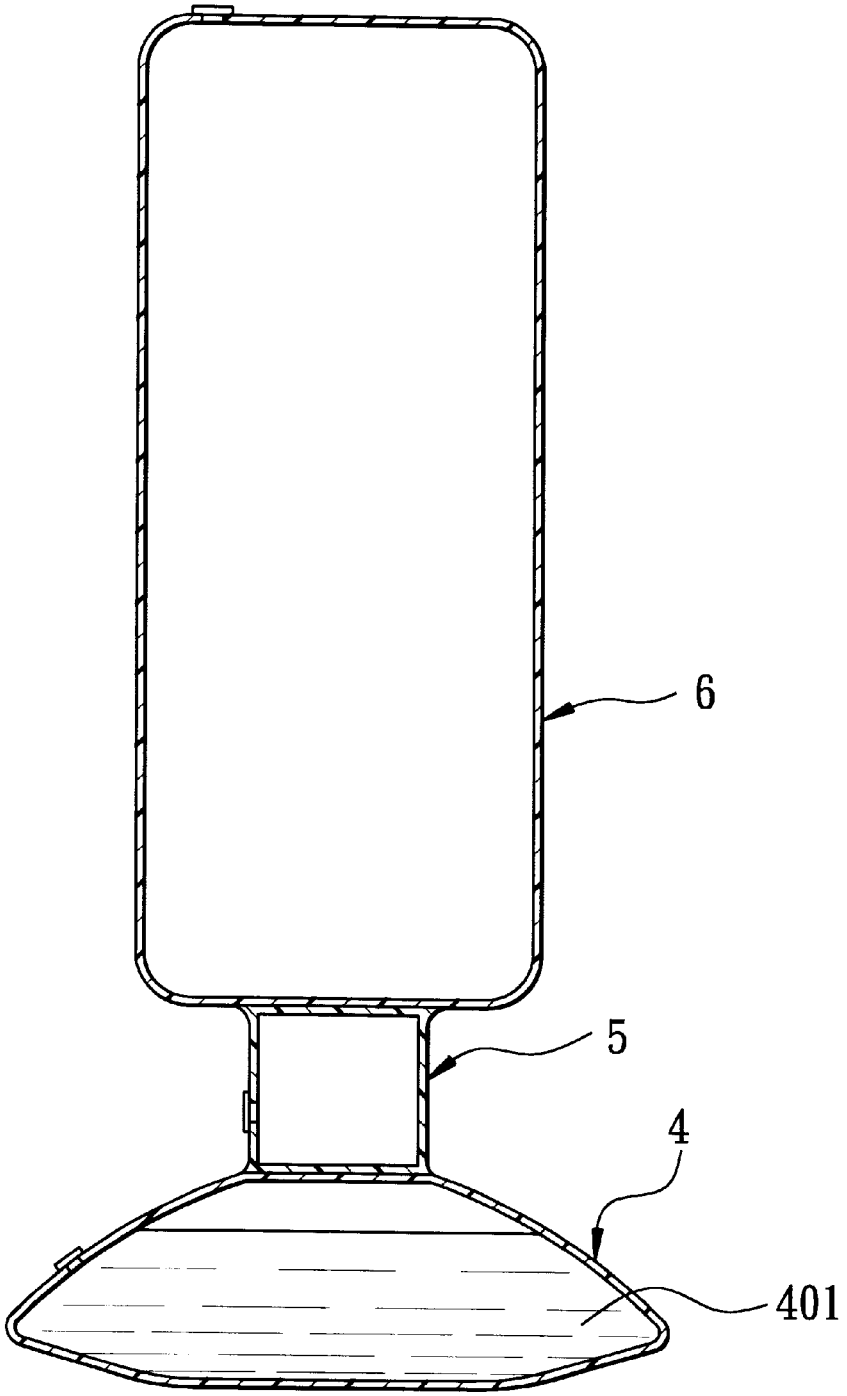
FIG. 2 PRIOR ART
FIG. 2 is a sectional view of another conventional punching bag.
Figure 3:
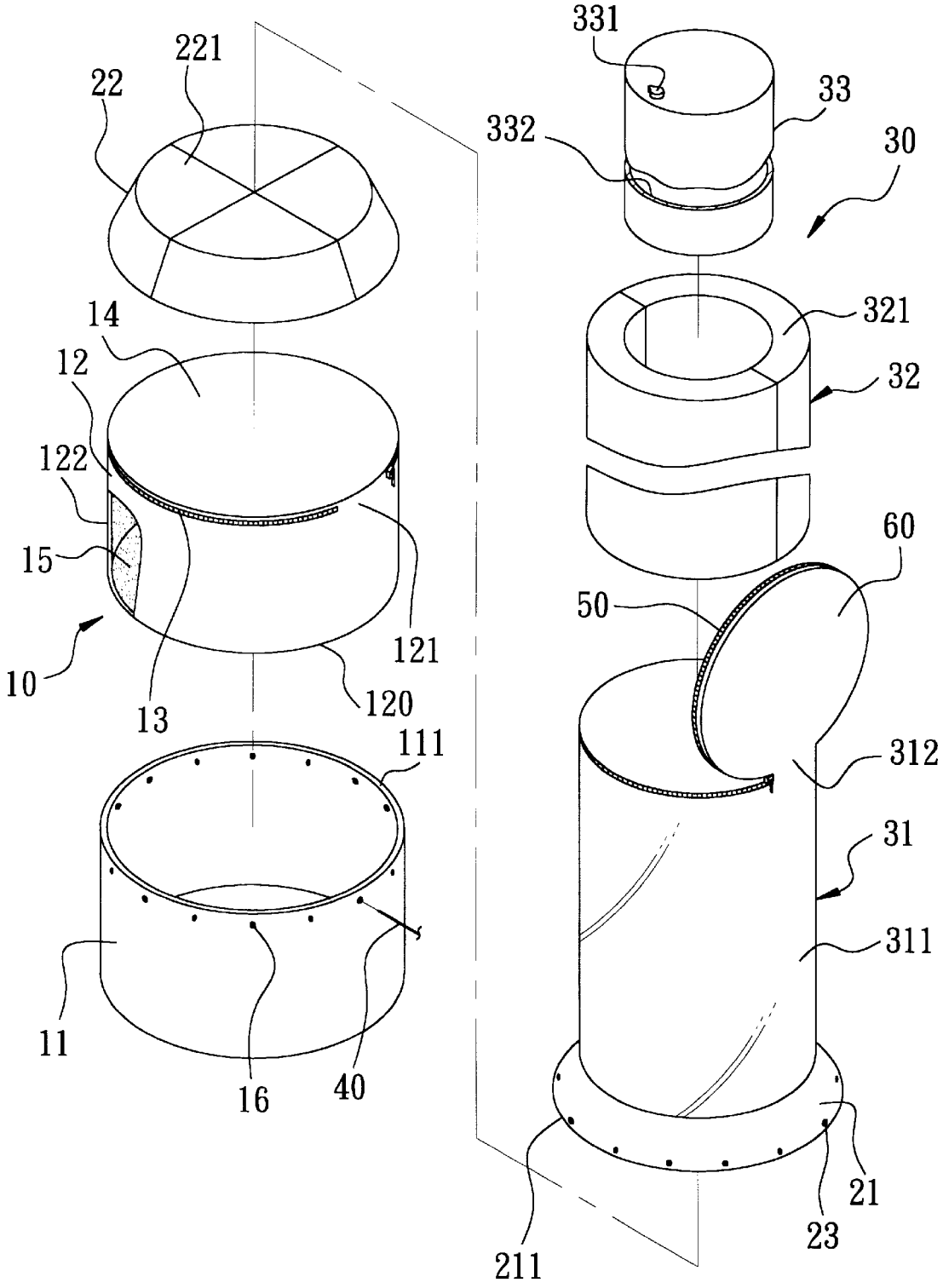
FIG. 3 is an exploded perspective view of a first preferred embodiment of a punching bag according to the present invention.
Figure 4:
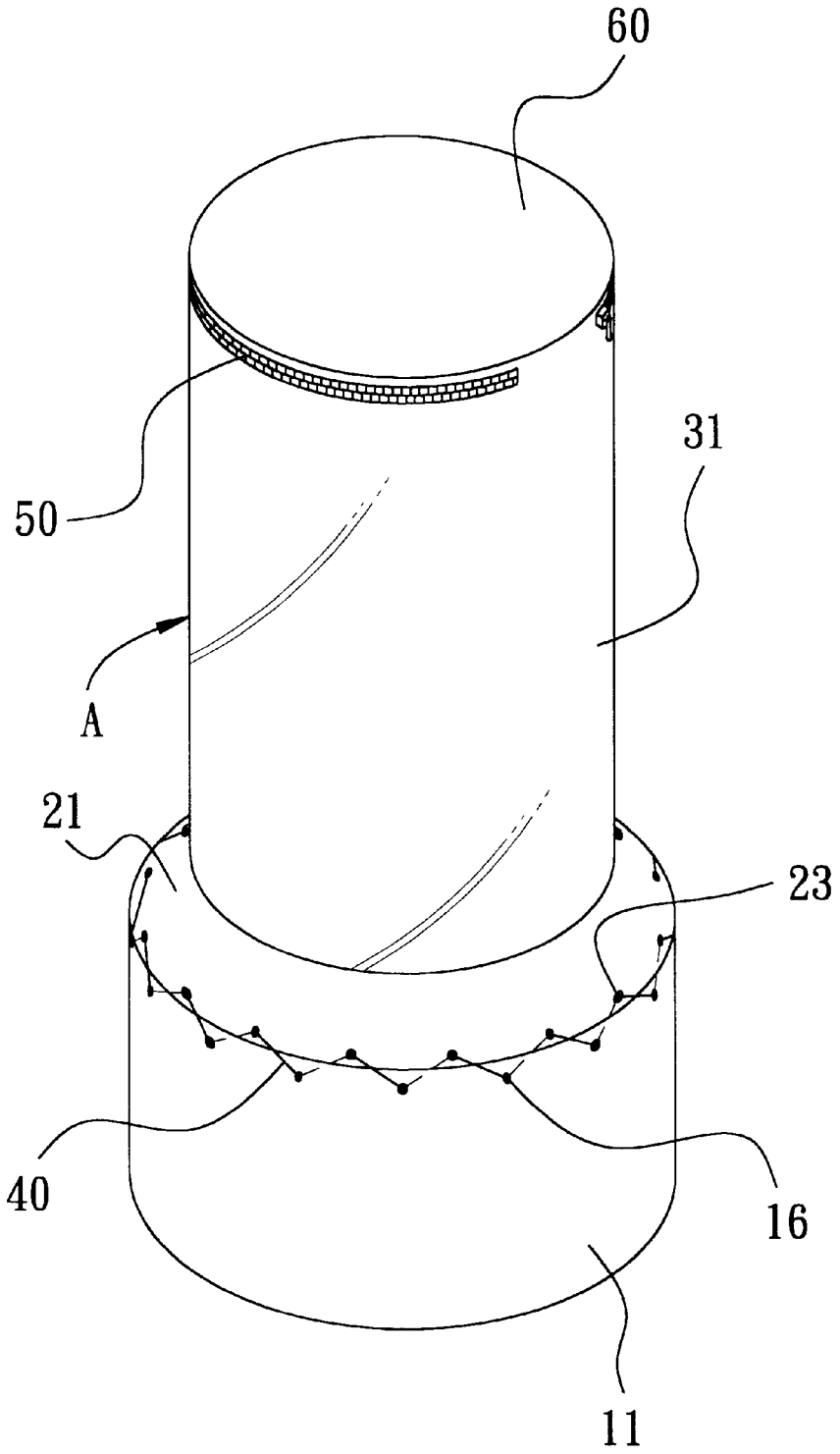
FIG. 4 is a perspective view of the first preferred embodiment.
Figure 5:
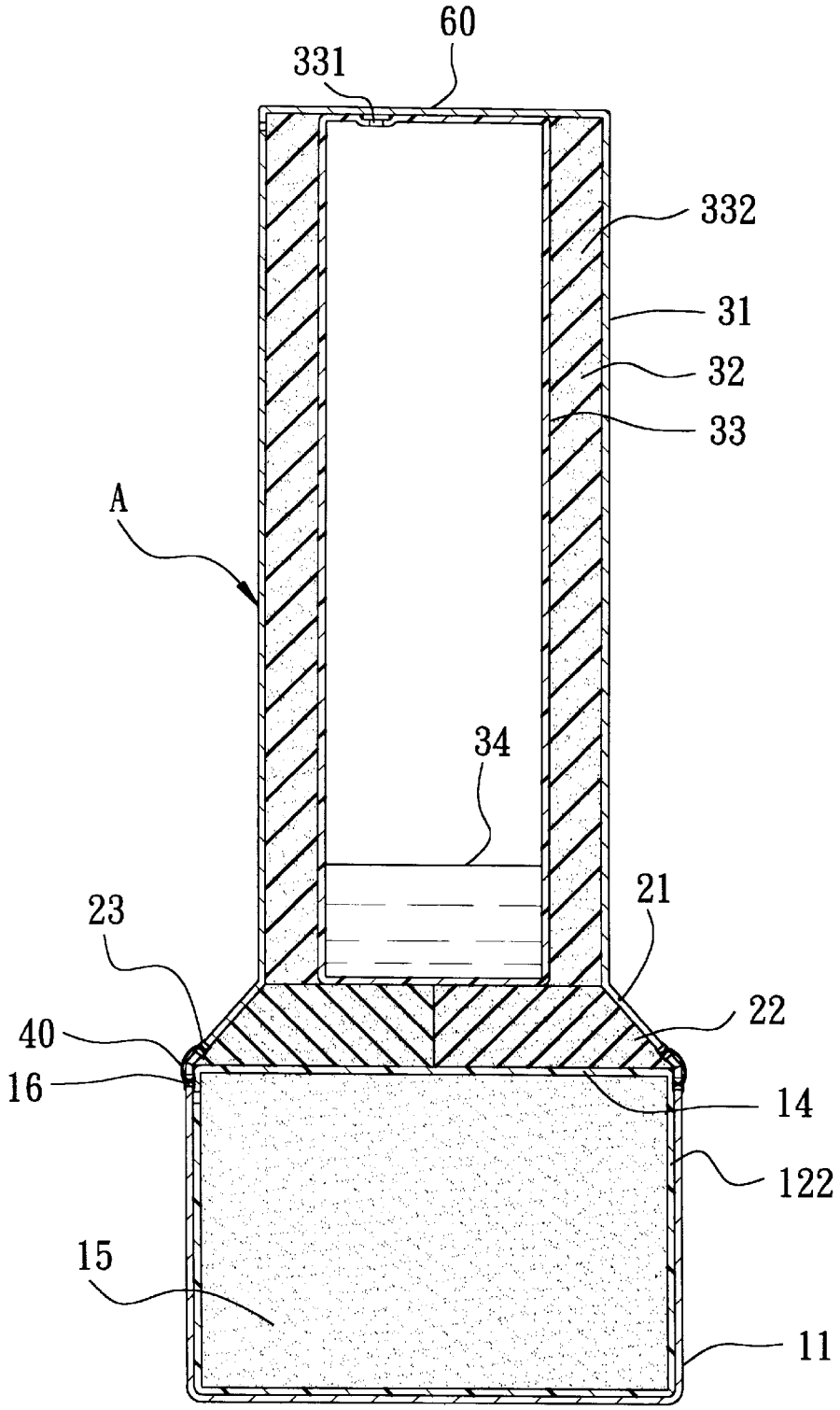
FIG. 5 is a sectional view of the first preferred embodiment.

Referring to FIGS. 3 to 5, according to the first preferred embodiment, a punching bag includes a base 10, a punching body 30 disposed above the base 10 and an outside bag (A).

The base 10 includes a base envelope 12 made of plastic or rubber. The base envelope 12 has a bottom wall 120, a first top cover 14, a first cylindrical wall 122 extending between the bottom wall 120 and the first top cover 14, and a zipper 13 attached to the first top cover 14 and the first cylindrical wall 122. The zipper 13 has a length shorter than that of the circumference of the first top cover 14 so as to leave a connecting portion 121 between two ends of the zipper 13. The first top cover 14, the bottom wall 120, and the first cylindrical wall 122 confine an inner space filled with sand 15, which serves as a weighing member.

The punch body 30 is lighter than the base 10 and includes a punch envelope 33. The punch envelope 33 has an inner space 332 which is filled with a fluid including air and water 34 via an inlet 331 disposed on a top face of the punch envelope 33. The punch body 30 further includes a hollow cushion body 32 made of a foam material. The cushion body 32 consists of two complementary arched foam blocks 321 which are sleeved around the punch envelope 33.

The bag (A) includes a lower enclosing portion 11 which is filled by the base 10 and which has a first joint end 111 with stitching holes 16, and an upper enclosing portion 31 filled by the punch body 30. The upper enclosing portion 31 includes a bottom skirt portion 21 which is formed with a second joint end 211 having stitching holes 23. The skirt portion 21 is flared toward the first joint end 111 of the lower enclosing portion 11. A foam body 22 consists of four substantially sector-shaped blocks 221 that complement one another to form a truncated cone-shape. The foam body 22 is filled in the skirt portion 21 and is positioned between the base 10 and the punch body 30. The upper enclosing portion 31 has a second cylindrical wall 311 connected to the skirt portion 21, a second top cover 60, and a zipper 50 having a length shorter than that of the circumference of the second top cover 60 so as to leave a connecting portion 312 between two ends of the zipper 50. A cord 40 is threaded through the stitching holes 16, 23 and fastens together the first and second joint ends 111, 211, as shown in FIG. 4.

When assembling the punching bag, the base envelope 12 of the base 10 is filled with sand 15 and is closed by the zipper 13. Then, the base envelope 12 is received in the lower enclosing portion 11 of the bag (A) so as to provide stabilizing effects to the punching bag. The foam body 22 is disposed on top of the base envelope 12. The upper enclosing portion 31 is superimposed on the foam body 22, and is connected to the lower enclosing portion 11 by the cord 40 that threads through the stitching holes 16, 23 alternatingly so that the upper enclosing portion 31 has an increased flexibility relative to the lower enclosing portion 11. Thereafter, the cushion body 32 is disposed in the upper enclosing portion 31, and the punch envelope 33 is filled with water 34 and air, as shown in FIG. 5, and is inserted into the cushion body 32 in the upper enclosing portion 31. After the zipper 50 is closed, assembly of the punching bag is completed.

As the base envelope 12 is filled with sand 15 as a supporting weight, the punching bag does not topple upon application of a punching force. Moreover, due to the presence of the cushion body 32 which provides softness and resiliency, a realistic feeling experienced when boxing can be obtained. In addition, the foam body 22, which is provided between the base 10 and the punch body 30 and which tapers upward to the punch body 30, can serve as an elastic support for pivoting and returning movement of the punch body 30 relative to the base 10. An additional advantage in the present invention is that the punching bag can be assembled easily by the usr.

Figure 6:
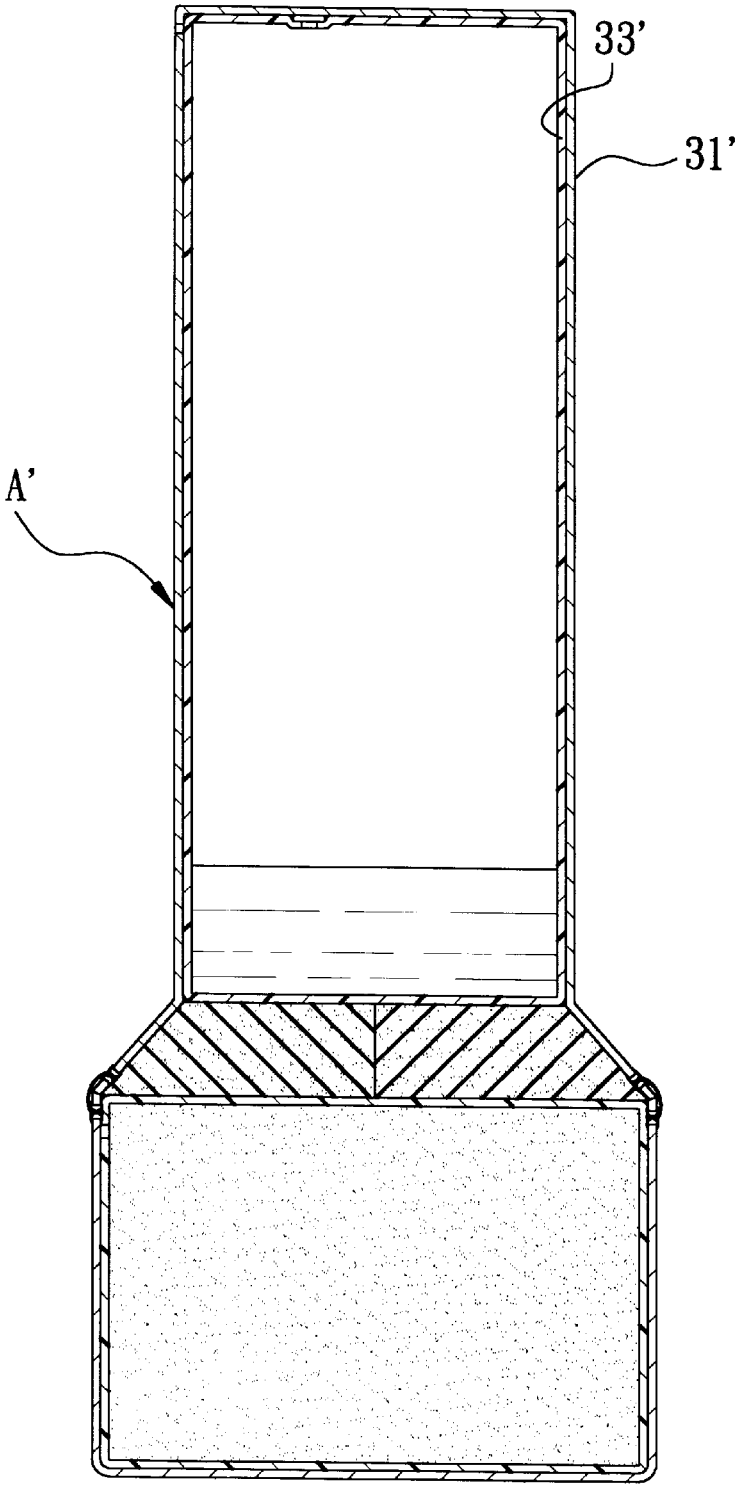
FIG. 6 is a sectional view of a second preferred embodiment of a punching bag according to the present invention.

FIG. 6 illustrates the second preferred embodiment of the present invention, which differs from the first preferred embodiment in that a punch body includes only a punch envelope 33' filled with water and air. There is no cushion body around the punch envelope 33'. However, an upper enclosing portion 31' of an outside bag (A') is made of artificial leather to provide an good feeling upon contact and to provide softness.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A punching bag, comprising:

a base including a base envelope and a weighing member filled in said base envelope;

a punch body disposed above said base and including a punch envelope and a fluid filled in said punch envelope, said punch body being lighter than said base, said base envelope having a cross-section greater than said punch envelope; and an outside bag which includes a lower enclosing portion filled by said base and having a first joint end with stitching holes, an upper enclosing portion filled by said punch body and having a second joint end with stitching holes, and a cord threading through said stitching holes and fastening together said first and second joint ends, said upper enclosing portion further having a bottom skirt portion which is formed with said second joint end, and which is flared toward said first joint end, and a foam body filled in said skirt portion and positioned between said base and said punch body.

2. The punching bag as claimed in claim 1, wherein said foam body has a truncated cone-shape.

3. The punching bag as claimed in claim 2, wherein said base envelope has a bottom wall, a first top cover, a first cylindrical wall extending between said bottom wall and said first top cover, and a zipper attached to said first top cover and said first cylindrical wall.

4. The punching bag as claimed in claim 2, wherein said upper enclosing portion of said bag includes a second cylindrical wall connected to said skirt portion, a second top cover, and a zipper attached said second top cover and said second cylindrical wall.

5. The punching bag as claimed in claim 1, wherein said punch body further includes a hollow cushion body sleeved around said punch envelope inside said upper enclosing portion.

6. The punching bag as claimed in claim 5, wherein said cushion body is made of a foam material.

7. The punching bag as claimed in claim 6, wherein said weighing member is sand.

8. The punching bag as claimed in claim 7, wherein said fluid in said punch envelope includes water and air.

9. The punching bag as claimed in claim 1, wherein said outside bag is made of leather.

10. The punching bag as claimed in claim 1, further comprising a foam body inserted in between said base and said punch body inside said outside bag.

* * * * *